United States Patent [19]

Lee

[11] 4,210,000

[45] Jul. 1, 1980

[54] REFRIGERATING APPARATUS

[76] Inventor: Doo S. Lee, 11-10 Miyakojimanakadori 3-chome, Miyakojimaku, Osaka, Japan

[21] Appl. No.: 867,279

[22] Filed: Jan. 5, 1978

[30] Foreign Application Priority Data

Mar. 9, 1977 [JP] Japan ..... 52-26543
Dec. 8, 1977 [JP] Japan ..... 52-148534

[51] Int. Cl.[2] ..... F25D 17/04; F25D 17/06; A47F 3/04

[52] U.S. Cl. ..... 62/417; 62/255; 62/426

[58] Field of Search ..... 62/255, 407, 417, 426, 62/406, 393, 418; 165/122, 108

[56] References Cited

U.S. PATENT DOCUMENTS 2,497,713 2/1950 Becker ..... 62/426
2,517,686 8/1950 Larkin ..... 62/417

FOREIGN PATENT DOCUMENTS 535722 1/1957 Canada ..... 62/417

*Primary Examiner*—Lloyd L. King
*Attorney, Agent, or Firm*—Armstrong, Nikaido, Marmelstein & Kubovcik

[57] ABSTRACT

An improved refrigerating apparatus for use as a refrigerator, showcase for frozen foods or the like, comprising an airtight chamber defined by an inner wall and an outer wall and hermetically enclosing air therein as separated from outside, a storage compartment defined by the inner wall and surrounded by the airtight chamber, a circulation passage provided within the airtight chamber for passing cold air around the storage compartment in circulation, and a cooler and blower disposed in the passage. The cold air flowing through the airtight chamber refrigerates the storage compartment through the heat conduction of the inner wall.

8 Claims, 6 Drawing Figures

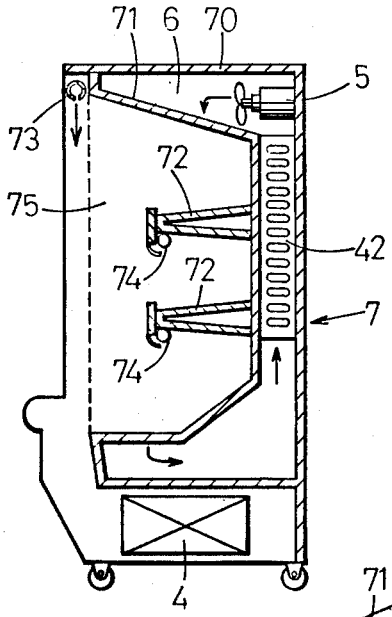
FIG.5
FIG.6
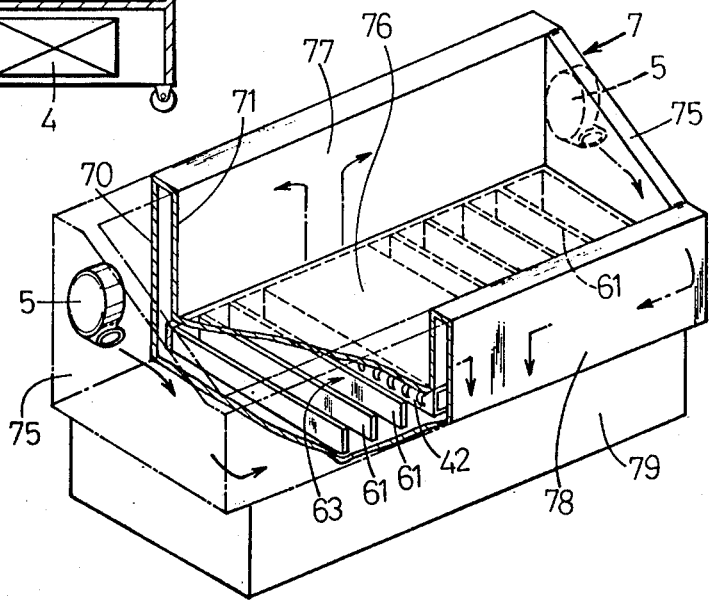

REFRIGERATING APPARATUS

BACKGROUND OF THE INVENTION

Refrigerators heretofore known include a heat exchanger serving as a cooler and disposed within a storage compartment, such that the air in the storage compartment is cooled by the cooler in direct contact therewith. Simultaneously with refrigeration, therefore, the water in the air within the refrigerator freezes on the surface of the cooler and covers the cooler with frost, consequently hampering the continuous operation of the cooler and drying the refrigerated foods due to the removal of water. For defrosting, the cooler must be heated suitably from time to time, but this gives rise to other attendant problems such as marked heat losses. Japanese Utility Model Publication for Objection No. 2119/1975, published on Jan. 21, 1975, discloses an improved refrigerator including a closed vegetable box placed in a storage compartment for preventing vegetables from drying, a cooler disposed in a freezer compartment above the storage compartment, and a circulation passage provided between the storage compartment and the freezer compartment for passing cold air along the wall of the closed box. With this structure, cold air flows out from the freezer compartment into the storage compartment, refrigerating the closed box from outside, and then returns to the freezer compartment in which the air comes into contact with the cooler. Accordingly, the refrigerator still involves problems in that the cold air comes into direct contact with the foods stored in the freezer and storage chambers, drying the foods by absorption of water and depositing frost on the surface of the cooler.

SUMMARY OF THE INVENTION

In view of the drawbacks of conventional apparatus, the object of this invention is to provide a refrigerating apparatus which includes a storage compartment surrounded by an airtight chamber from outside and in which the air coming into contact with the cooler is separated from the air within the storage compartment so that the apparatus can be continuously operated free of frosting, eliminating the necessity for defrosting and without causing dehumidification within the storage compartment to prevent the refrigerated foods from drying.

BRIEF DESCRIPTION OF THE DRAWINGS

FIG. 5 is a view in vertical section of a showcase of the upright type for frozen foods; and FIG. 6 is a perspective view partly broken away and showing a showcase of the horizontal type for frozen foods.

DESCRIPTION OF THE PREFERRED EMBODIMENTS

Figure 1:
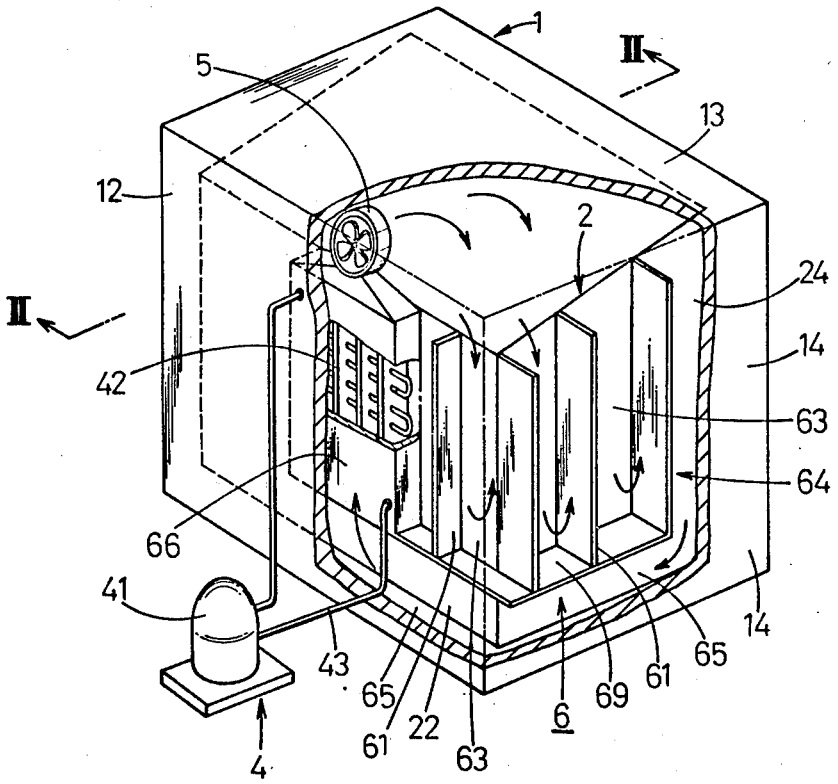
FIG. 1 is a perspective view partly broken away and showing a refrigerator according to this invention.
Figure 2:
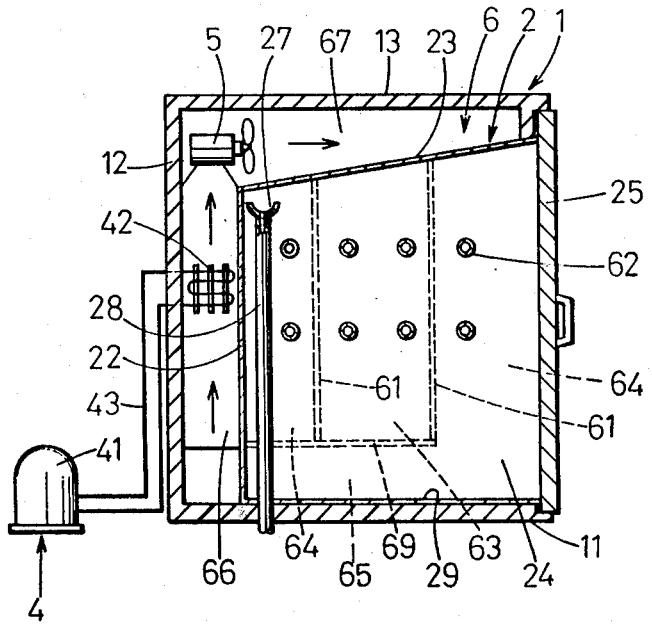
FIG. 2 is a view in vertical section taken along the line II—II in FIG. 1 to show the refrigerator.

FIGS. 1 and 2 show a refrigerating apparatus in the form of a refrigerator 1 embodying this invention. The refrigerator 1 has a storage compartment 2 of hermetic construction provided with a door 25 at its front opening. The refrigerator 1 has a heat-insulated outer wall which is slightly spaced apart from the wall of the storage compartment 2.

The wall defining the storage compartment 2 is hermetically made from sheet metal. An air flow passage of predetermined thickness is provided between and defined by the outer wall of the refrigerator 1 and the wall defining the storage compartment 2. Thus the storage compartment 2 is surrounded by an airtight chamber 6 independent of the storage compartment 2 and separated from outside. The top wall 23 of the storage compartment 2 is inclined downward from the door side 25 toward its rear wall 22. A horizontal trough 27 extending along the lower end of the top wall 23 is provided at its one end with a drain tube 28. The water evaporating off from the foods stored in the storage compartment 2 flows down the top wall 23, is collected by the trough 27 and flows out from the refrigerator through the drain tube 28.

Vertical ribs 61 are provided between the side walls 24 of the storage compartment 2 and the side plates 14 of the refrigerator 1 as well as between the rear wall 22 of the storage compartment 2 and the rear plate 12 of the refrigerator 1. Cold air retaining spaces 63 closed by closing plates 69 at their lower ends are provided between the ribs 61. Circulation passages 65 are formed below the closing plates 69. A vertical circulation passage 66 is formed at the center of the rear side of the rear wall 22. The space 67 between the top wall 23 and the top plate 13 communicates with circulation passages 64 on the opposite sides of the storage compartment 2, with the cold air retaining spaces 63 and with the passage 66 on the rear wall 22.

Drive means 41 for a freezer 4 is provided in a lower portion of the refrigerator 1 or on the floor away from the refrigerator 1. A cooler 42 disposed in the passage 66 on the rear wall 22 is connected to the drive means 41 by ducts 43. A blower 5 is disposed at an upper portion of the passage 66. The air enclosed in the airtight chamber 6 is separated from the atmosphere and the storage compartment 2 and is sent into the space 67 on the top wall 23 by the blower 5. Cold air flows down into the retaining spaces 63 and passages 64, from which the air flows through the lower passages 65 and returns to the passage 66 on the rear wall 22, where it is cooled. The storage compartment 2 is refrigerated with the circulating cold air through the heat conduction of the wall partitioning the airtight chamber 6 from the compartment 2 and is insulated from the heat from outside. Since the interior of the airtight chamber 6 is out of communication with the outside, water will not adhere to the cooler 42 in the form of frost. This eliminates the necessity of defrosting which would entail great heat losses, permitting continuous operation of the freezer 4. As seen in FIG. 2, the present embodiment may be provided with tubes 62 extending across the storage compartment 2 between the opposite side walls 24 and in a multi-stage horizontal arrangement, the tubes 62 being in communication with the circulation passages 64 on the opposite sides to lead the refrigerating air stream therethrough, whereby the storage compartment 2 can be cooled with improved efficiency. The tubes 62 are useful also as partitioning shelves.

Figure 3:
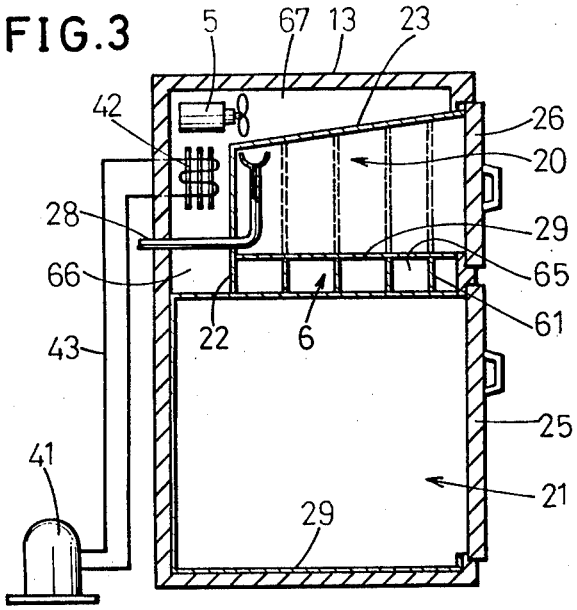
FIGS. 3 and 4 are views in vertical section showing a refrigerator according to another embodiment of this invention.

When the space behind the storage compartment 2 is small, a freezer compartment 20 is provided in the upper portion of the refrigerator 1 and a refrigerating compartment 21 in its lower portion, with doors 25 and 26 provided for the compartments 20 and 21 respectively as seen in FIG. 3. The bottom plate 29 of the freezer compartment 20 and the top wall of the refrigerating compartment 21 define an airtight chamber 6 between the two compartments 20 and 21. Ribs 61 are arranged in the airtight chamber 6 the interior space of which serves as a passage 65 for cooling air. The cold air produced by a cooler 42 flows into the space 67 above the top wall 23, from which the air dividingly flows down along the opposite side walls and enters the space 65 beneath the bottom wall 29. The air flows from the center of the bottom wall into a passage 66 behind the rear wall 22 and returns to the cooler 42. The freezer compartment 20 is cooled through the surrounding wall and the refrigerating compartment 21 through the top wall by virtue of heat conduction.

The circulation passages in the airtight chamber 2 shown in the drawings are given for illustrative purposes and can be modified variously for practical use. For instance, the cooler 42 can be disposed in the space above the top wall 23 or in a space formed below the bottom wall 29, with an air stream circulating channel provided along the bottom wall 29, opposite side walls 24 and top wall 23.

Figure 4:
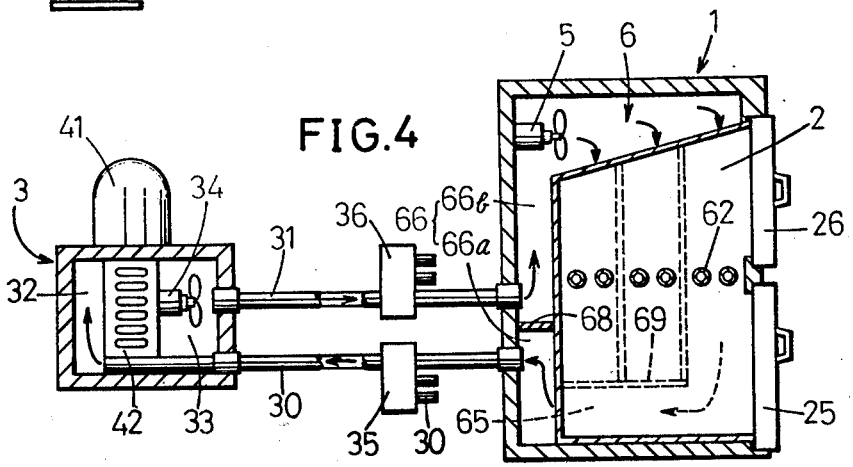

FIG. 4 shows an embodiment in which a cooler 42 is housed in a cooler box 3 disposed outside the refrigerator 1. The circulation passages in the airtight chamber 6 communicate with the cooler box 3 by way of hoses 30 and 31. The cooler box 3 is positioned above or below the refrigerator 1 or at a location away therefrom. The surrounding wall of the box 3 is made of heat-insulating material and formed in its interior with an inflow chamber 32 and an outflow chamber 33 in the rear and front of the cooler 42 accommodated therein. The passage 66 behind the storage compartment 2 is provided with a partition plate 68. A passage 66*a* under the partition 68 communicates with the inflow chamber 32 of the cooler box 3 via the hose 30, while another passage 66*b* above the partition 68 communicates with the outflow chamber 33 of the cooler box 3 by way of the other hose 31. The air stream circulating channel therefore includes the cooler box 3 and hoses 30 and 31 which are disposed outside the refrigerator 1. The air within the airtight chamber 6 flows along the opposite sides of the storage compartment 2 through the lower passages 65 and 66*a* into the hose 30 below the partition 68 and then into the inflow chamber 32 in the cooler box 3. The air passing through the cooler 42 and thereby cooled is forced out by a fan 34 in the outflow chamber 33 through the other hose 31 and enters the passage 66*b* above the partition 68 and flows around the storage compartment 2.

The hoses 30 and 31 may be provided with headers 35 and 36 for gathering hoses for a plurality of refrigerators to join the air flows from the refrigerators and send the combined air to the cooler box, the arrangement further being such that the air stream from the cooling box 3 is divided and sent to the individual refrigerators. This arrangement has the advantage that the plurality of refrigerators can be cooled by a single cooler 42.

FIGS. 5 and 6 show open-type showcases 7 for frozen foods embodying this invention. The showcase illustrated in FIG. 5 is of the upright type which is open on its front side. An inner wall 71 made of sheet metal is provided inside an outer wall 70 as spaced apart therefrom by a small clearance to form an airtight chamber 6 between the outer wall 70 and the inner wall 71. A cooler 42 is disposed in the space of the airtight chamber in a rear portion of the showcase 7. A blower 5 is disposed in the space above the cooler 42. An air stream circulation passage, separated from the outside, is formed between the outer wall 70 and the inner wall 71. A freezer 4 provided in a lower portion of the showcase 7 operates the cooler 42. The opposite side walls 75 of the showcase are connected together by hollow shelves 72 through which cold air is passed to freeze the commercial articles placed on the shelves. As already known, the showcase 7 is provided at an upper portion of the opening with an air discharge nozzle 73 to form an air curtain across the front opening. Lamps 74 are attached to the bottom sides of the shelves 72 to illuminate the articles.

FIG. 6 shows a showcase of the horizontal type which is open on its upper side. An airtight chamber 6 is defined by the outer wall 50 and inner wall 71 of the showcase. Blowers 5 are disposed in the internal spaces of opposite side walls 75. Provided in the internal space of bottom wall 76 are a cooler 42 in the center and ribs 61 on the opposite sides of the cooler 42. Thus air flows through the circulation channel of: cooler 42→rear wall 77→side walls 75→front wall 78→bottom wall 76→cooler 42. The bottom wall 76 includes cold air retaining spaces 63 surrounded by the ribs 61 and a closing plate 69. Drive means for the cooler 42 is provided in a frame 79 under the showcase 7 and connected to the cooler 42.

With the showcases of FIGS. 5 and 6, the cooler 42 can be provided in a cooler box installed at a location away from the showcase as in the embodiment of FIG. 4, such that the airtight chamber and the cooler box are interconnected by two hoses to provide a cold air circulation channel including the internal spaces of the walls of the showcase, hoses and cooler box. The hoses extending from the cooler box can be connected to the circulation channels of several like showcases so as to refrigerate the showcases at the same time by a single cooler.

In any of the foregoing embodiments, the air passing through the cooler 42 is separated from outside and storage compartment by the walls defining the airtight chamber 6. This renders the cooler continuously operable free of deposition of frost without the necessity of defrosting. Additionally the foods stored in the storage compartment are kept out of contact with cold air and can therefore be reserved free of degradation. Thus the apparatus of this invention have outstanding advantages.

This invention is not limited to the drawings and the description given above but can be modified variously without departing from the spirit of the invention. It should be understood that such modifications are included within the scope of this invention.

I claim:

1. A refrigerating apparatus in which air is passed through the cooler of a freezer in contact therewith to cool the air, said apparatus comprising:

an airtight chamber having an inner wall defining a storage compartment, an outer wall slightly spaced apart from the inner wall, ribs provided within the airtight chamber and closing plates provided between the ribs wherein air retaining spaces and air circulation channels are formed in the airtight chamber;

cooling means disposed within the airtight chamber for cooling the air enclosed in the airtight chamber; and a blower provided within the airtight chamber, wherein the airtight chamber is isolated from outside and wherein a portion of the cooling air flowing out from the cooling means stagnates in the air retaining spaces and remaining cooling air passes through the circulation channels to refrigerate the storage compartment through the inner wall and returns to the cooling means.

2. A refrigerating apparatus as defined in claim 1 wherein airtight hollow tubes extending across the storage compartment and communicating with the airtight chamber interconnect the opposed side walls of the storage compartment, and the air stream circulating through the airtight chamber partly passes through the hollow tubes.

3. A refrigerating apparatus as defined in claim 1 wherein the storage compartment is provided with a door at the opening and said apparatus is a refrigerator-freezer.

4. A refrigerating apparatus as defined in claim 1 wherein the inner wall defines a freezer compartment having a top wall, opposite side walls, a rear wall, a bottom wall, an open front side and a door at the opening, a refrigerating compartment being disposed below the freezer compartment and having a door, the cooling means comprising a cooler disposed in the airtight chamber on the rear wall, the blower being disposed in the airtight chamber on the top wall, the air circulation channel permitting the cold air passing through the cooler to enter a space above the top wall, dividedly flow down the opposite side walls into a space between the bottom wall and the top wall of the refrigerating compartment and return to the cooler so that the cold air passing through a portion of the channel under the bottom wall of the freezer compartment cools the refrigerating compartment through the top wall of the refrigerating chamber.

5. A refrigerating apparatus as defined in claim 1 wherein the inner wall defines a box-shaped storage compartment having a top wall, opposite side walls, a rear wall and a bottom wall and open on its front side, the cooling means comprising a cooler disposed in the airtight chamber on the rear wall, the blower being disposed in the airtight chamber on the top wall, the air circulation channel permitting the cold air passing through the cooler to enter a space above the top wall, dividedly flow down the opposite side walls, enter a space under the bottom wall from the lower ends of the side walls and return to the cooler through a passage at a lower portion of the rear wall.

6. A refrigerating apparatus as defined in claim 5 wherein the storage compartment is a showcase of the upright type.

7. A refrigerating apparatus as defined in claim 1 wherein the inner wall defines a box-shaped storage compartment having opposite side walls, front and rear walls and a bottom wall and open on its upper side, the cooling means comprising a cooler being disposed in the airtight chamber under the bottom wall, blowers being disposed in the airtight chamber in the opposite side walls, the air circulation channel permitting the cold air passing through the cooler to enter the interior of the rear wall, dividedly flow into the internal spaces of the opposite side walls and then into the internal space of the front wall and return to the cooler through a space under the bottom wall.

8. A refrigerating apparatus as defined in claim 7 wherein the storage compartment constitutes a showcase of the horizontal type.

* * * * *